US009101215B2

(12) United States Patent
Kreyenkamp et al.

(10) Patent No.: US 9,101,215 B2
(45) Date of Patent: Aug. 11, 2015

(54) FITTING FOR CORNER CABINETS

(75) Inventors: Reiner Kreyenkamp, Bad Essen (DE); Dietmar Baro, Berlin (DE)

(73) Assignee: Kesseböhmer Holding e.K., Bad Essen (DE)

( * ) Notice: Subject to any disclaimer, the term of this patent is extended or adjusted under 35 U.S.C. 154(b) by 0 days.

(21) Appl. No.: 14/119,538

(22) PCT Filed: May 23, 2011

(86) PCT No.: PCT/EP2011/002550
§ 371 (c)(1),
(2), (4) Date: Feb. 1, 2014

(87) PCT Pub. No.: WO2012/159642
PCT Pub. Date: Nov. 29, 2012

(65) Prior Publication Data
US 2014/0197722 A1 Jul. 17, 2014

(51) Int. Cl.
*A47B 81/00* (2006.01)
*A47B 96/02* (2006.01)

(52) U.S. Cl.
CPC ..... *A47B 96/028* (2013.01); *A47B 81/002* (2013.01); *A47B 96/024* (2013.01)

(58) Field of Classification Search
CPC ..... A47B 2210/0056; A47B 96/16; A47B 81/002; B65F 1/1436; B65F 1/1442; F25D 25/027
USPC ..... 312/273, 274, 311, 238, 275
See application file for complete search history.

(56) References Cited

U.S. PATENT DOCUMENTS

| | | | | |
|---|---|---|---|---|
| 1,899,171 | A * | 2/1933 | Warren | 312/275 |
| 2,532,405 | A * | 12/1950 | Jakeway | 312/8.5 |
| 2,724,629 | A * | 11/1955 | Atchison | 312/274 |
| 4,413,868 | A * | 11/1983 | Gorkiewicz | 312/211 |
| 4,639,051 | A * | 1/1987 | DeBruyn | 312/275 |
| 4,870,315 | A * | 9/1989 | Neuhaus | 312/309 |
| 6,857,711 | B1 * | 2/2005 | Straus | 312/205 |
| 7,318,631 | B2 * | 1/2008 | Kreyenkamp | 312/238 |
| 2006/0012273 | A1 * | 1/2006 | Kreyenkamp | 312/238 |
| 2010/0084952 | A1 * | 4/2010 | Sagel | 312/238 |

FOREIGN PATENT DOCUMENTS

| | | |
|---|---|---|
| DE | 37 30 374 A1 | 3/1988 |
| DE | 89 05 283 U1 | 6/1989 |

(Continued)

*Primary Examiner* — Hanh V Tran
(74) *Attorney, Agent, or Firm* — Gudrun E. Huckett

(57) ABSTRACT

A fitting for corner cabinets with rectangular interior accessible from the front side via a corner cabinet door is provided with a support supported in the interior (2) of the corner cabinet and supporting at least one guide member (5) which supports and moves the shelf (4) on a predetermined movement path from the interior of the corner cabinet (1) to an outer position in front of a door opening. A driver device arranged between the corner cabinet door and the shelf (4) is provided to couple the door (3) to the shelf (4) during the opening movement of the door. The driver device has a stationary driver (6) mounted on the door and an unlockable coupling element (8) fixed to the shelf (4) can be introduced and be moved in a guide slot to ensure a drive function between the corner cabinet door (3) and the shelf (4). The coupling element (8) has a height-adjustable drive area introduced automatically, from an unlocked position, by a relative movement of the shelf (4) in relation to the door (3), into a drive position in the guide slot (7), and unlocked by manually activating the height adjustment of the drive area (9).

9 Claims, 5 Drawing Sheets

(56) References Cited

FOREIGN PATENT DOCUMENTS

| | | | | | |
|---|---|---|---|---|---|
| DE | 91 16 055 | U1 | | 2/1992 | |
| DE | 94 19 562 | U1 | | 2/1995 | |
| DE | 20 2004 011 200 | U1 | | 1/2006 | |
| DE | 20 2005 016 432 | U1 | | 1/2006 | |
| DE | 10 2007 009 894 | C5 | | 5/2010 | |
| DE | 20 2010 014 345 | U1 | | 2/2011 | |
| EP | 563933 | A2 | * | 10/1993 | ..... A47B 49/00 |

* cited by examiner

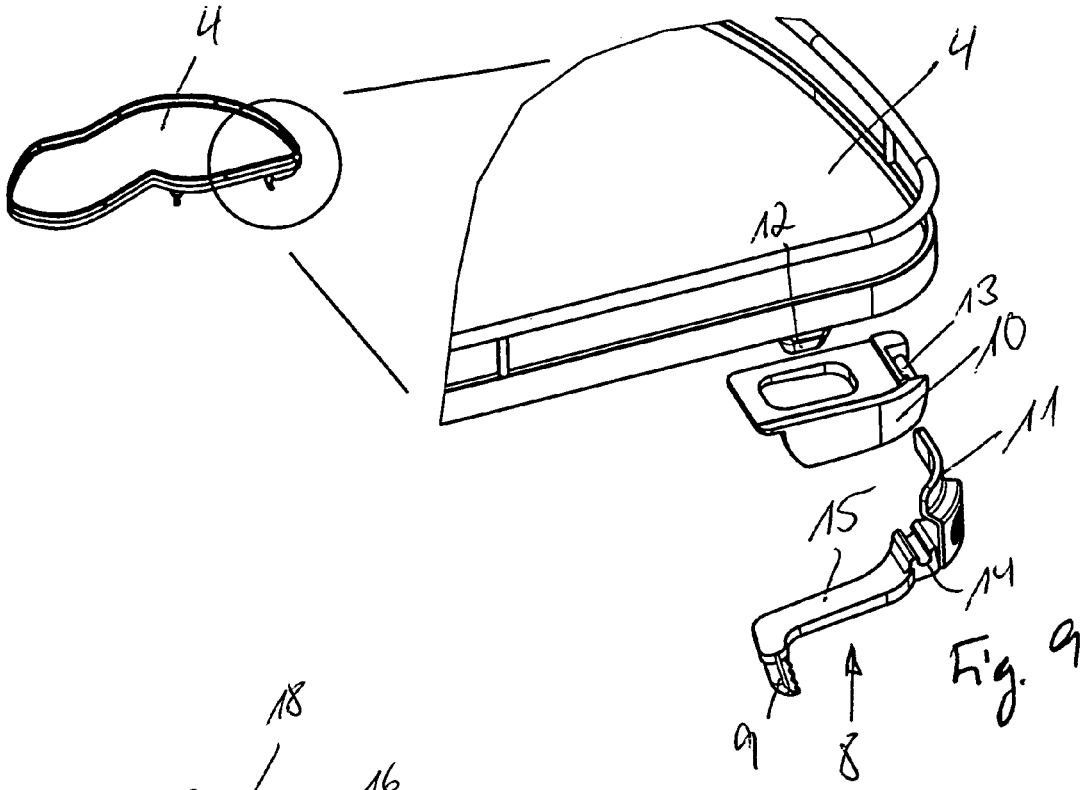
Fig. 9
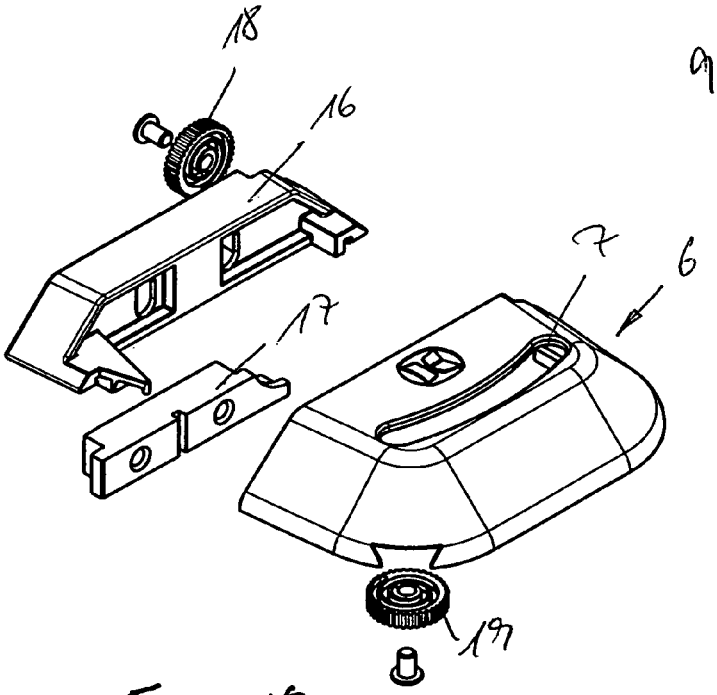
Fig. 10
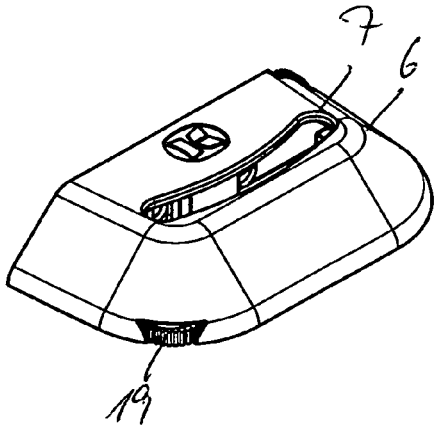

FITTING FOR CORNER CABINETS

BACKGROUND OF THE INVENTION

The invention concerns a fitting for corner cabinets, in particular for kitchen corner cabinets, comprising an interior that is accessible by means of a corner cabinet door at the front side and is substantially rectangular in horizontal section, comprised of at least one support stationarily supportable in the interior of the corner cabinet for securing at least one one-part shelf of a basic shape that is similar to a semicircle, wherein the support has at least one guide member that supports the shelf and transfers the shelf on a predetermined movement path from an inner position in the interior of the corner cabinet into an outer position that is substantially located in front of the door opening of the corner cabinet, wherein the guide member is articulated on the bottom side of the shelf and is connected pivotably by means of a support fitting with a corner cabinet part, in particular a sidewall part, wherein between the corner cabinet door that closes off the door opening and the shelf a driver device is provided for coupling the door with the shelf during at least one segment of the opening movement of the door.

A fitting for corner cabinets is disclosed in DE 20 2004 011 200 U1. This fitting has a support with two guide members that control a predetermined movement path of the shelf wherein one guide member is supported on a stationary support column in the interior of the corner cabinet in a pivotable way and another one is supported on a sidewall of the corner cabinet. The two guide members are articulated on the bottom side of each shelf so that they ensure that the shelf is movably supported such that not only a pivot movement about an axis can be performed but moreover the shelf can perform also an additional movement relative to a circular movement path which makes it possible that, as a result of this movement path controlled by the two guide members, a final position can be assumed in which the shelf is positioned for the most part in front of the door opening of the corner cabinet.

It is particularly advantageous in this context that also in case that several shelves are provided that are positioned at a spacing above each other, as a result of the individual guide members associated with each shelf, the shelves can also be individually pivoted outwardly without the other provided shelves having to be mandatorily entrained. In this connection, each shelf support surface is accessible from above for the user.

DE 20 2005 016 432 U1 discloses a pivotable pull-out device for a corner cabinet that, in analogy to the fitting system disclosed in the afore mentioned document, operates with two guide members, wherein one is attached to a sidewall of the cabinet and another to a vertical support column. Due to the two provided guide members, it is also possible to transfer in this system a shelf for the most part to a position in front of the door opening. As a result of a support arm-like construction provided thereat, two shelves that are arranged above each other can only be moved together into the outer position located in front of the door opening so that the lower shelf positioned underneath the upper shelf is no longer freely accessible from above.

DE 10 2007 009 894 C5 discloses a corner cabinet, in particular a kitchen corner cabinet, with a cabinet body and an interior that is accessible by means of a corner cabinet door that is supported on the cabinet body and can be moved between a closed position and an open position, wherein in the interior at least one shelf is supported by means of a fitting so as to be movable between an inner position and an outer position, wherein a driver device is provided by means of which the corner cabinet door and the shelf are motion-coupled. For this purpose, decoupling means in the form of a bolt and a guide part are provided. The bolt engages the guide part such that the bolt from a certain intermediate shelf position on is automatically decoupled from the guide part. With this automatic decoupling the shelf is however still mostly located within the cabinet interior so that this device is not suitable for fast access to objects supported on the shelf.

It is the object of the present invention to provide a fitting for corner cabinets of the aforementioned kind that enables safe entrainment of the shelf during a pivot movement for opening the door but also additionally enables a simple manual decoupling action.

SUMMARY OF THE INVENTION

As a solution to this object, the corner cabinet of the aforementioned kind is characterized in that the driver device comprises a driver that is stationarily attached to the door and has a guide slot into which a releasable coupling member secured to the shelf for a driver action between corner cabinet door and shelf is inserted and movable therein, wherein the coupling member has a height-adjustable driver segment that is insertable into the guide slot and is automatically insertable into the guide slot from an unlocked position into a driver position by a relative movement of the shelf relative to the door, wherein the coupling member can be unlocked by a height adjustment of the driver segment that can be manually activated. With regard to important further embodiments, reference is being had to the dependent claims.

Accordingly, a fitting for corner cabinets is made available with which a safe entrainment of the shelf during a door entraining movement is ensured and that moreover enables an unlocking action that is extremely simple to handle in any position of the door. Moreover, the fitting is also capable of automatically effecting coupling or locking of the coupling member in the guide slot of the driver on the door. Due to this automatic mechanism that can be realized by simple means it is possible to initially pivot wide open the shelf with the door which is beneficial for fast access of objects on the shelf support surface. In particular, the fast accessibility across a large area is enabled for a great support surface area of the shelf when, as is known in the art, the shelf is moveable, controlled by two guide members, into the open pivoted position or intermediate position because in this embodiment it is made possible to enable entrainment of the shelf for a pivot angle of the door of approximately 85° so that the door is essentially completely open. Then, by means of a simple manual unlocking action, the coupling member can be released from the guide slot and the shelf can then be moved farther, again controlled by the guide members, into a position in which it is for the most part in front of the cabinet.

In a subsequent return movement, the coupling member is introduced by its own action, i.e., automatically, into the guide slot of the driver as a result of the relative movement, which is made possible by the height adjustment of the driver segment of the coupling member in that, for example, it glides across slanted surfaces of lateral areas or a front side of the driver with height adjustment and then can dip again into the guide slot.

With regard to the configuration of the height adjustment means, various embodiments can be realized. For example, it is conceivable to provide a springy yielding action of a driver segment at the coupling member or, as a result of a suitable material selection, a material-based elastic yielding action. Moreover, the driver segment can be secured, for example, pivotably, on a holder, for example, configured together with an actuator that can be manually activated, so that unlocking as well as the automatic yielding action in case of a locking action can be realized by means of the pivot or tilting axis.

BRIEF DESCRIPTION OF THE DRAWINGS

Further advantageous embodiments of the invention result from further dependent claims, the following description, and the drawing. In the drawing it is shown in:

FIG. 9 enlarged individual parts of an embodiment of a coupling member;

FIG. 10 individual parts of an embodiment of a driver that is to be attached to the door.

In the drawing, parts that basically operate the same are identified with identical reference characters.

DESCRIPTION OF PREFERRED EMBODIMENTS

Figure 1:
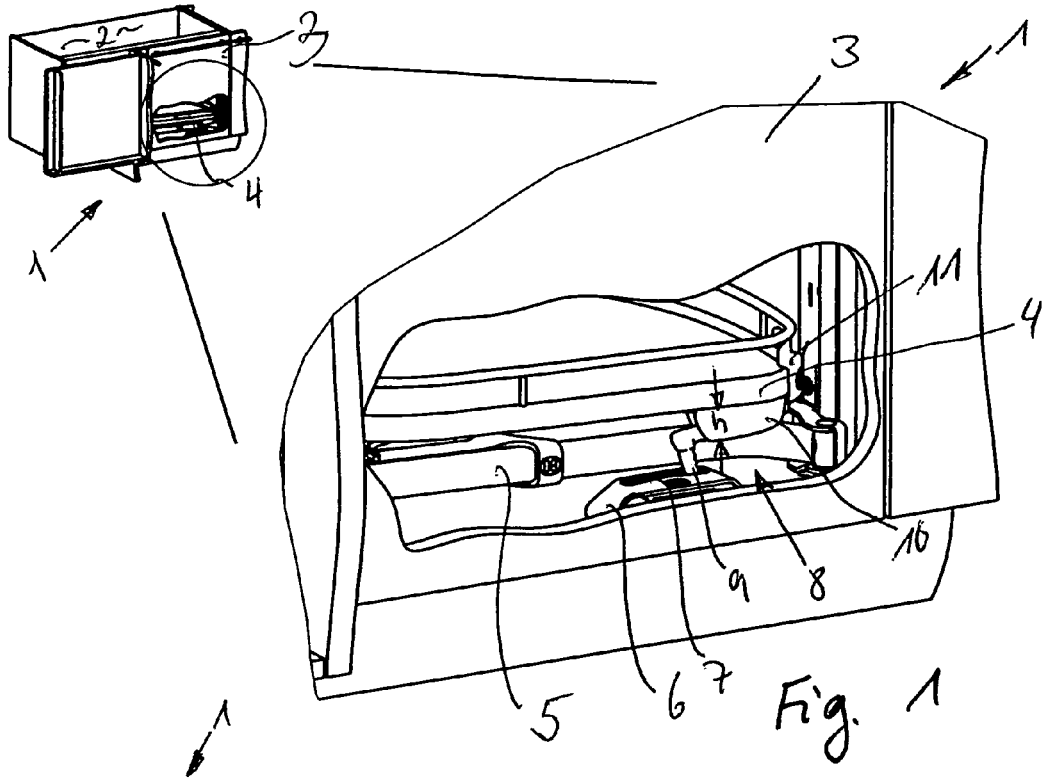
FIG. 1 an embodiment of a fitting for a corner cabinet in the closed position of the door of the corner cabinet, wherein in FIG. 1, as in FIGS. 1 through 8, to the left at the top a corner cabinet is illustrated and the corner cabinet door in each case is partially broken away.

A corner cabinet is identified generally by 1 with a cabinet interior 2 and a cabinet door 3. The cabinet door is closed in the illustration according to FIG. 1. In the interior of the cabinet 2, a shelf 4 is arranged having at its bottom side two guide members 5 articulated to the shelf. The second guide member is shown, for example, in FIGS. 5 and 6. By means of these two guide members 5, the shelf 4 can perform a controlled movement so that is can be transferred from the position illustrated in FIG. 1 within the cabinet into the position shown in FIG. 6 in which the shelf is located for the most part in front of the cabinet or in front of the cabinet opening with the door open. It is possible that several shelves 4 are positioned above each other in the cabinet interior 2 and are each supported by separate guide members 5 in the afore described meaning.

A driver 6 is provided stationarily on the door 3 and has a guide slot 7. A coupling member 8 that has a driver segment 9 can be inserted into this guide slot 7.

The coupling member 8 is attached to the bottom side of the shelf 4 wherein the driver segment 9, as can be already seen in FIG. 1, is height-adjustable and designed such that it can be moved within the range h so as to adjust its height. For this purpose, the coupling member 8 has a holder 10 with an actuator 11. In the illustration of FIG. 1, the driver segment 9 of the coupling member 8 is within the area of the guide slot 7 that is to the right in the illustration.

Figure 2:
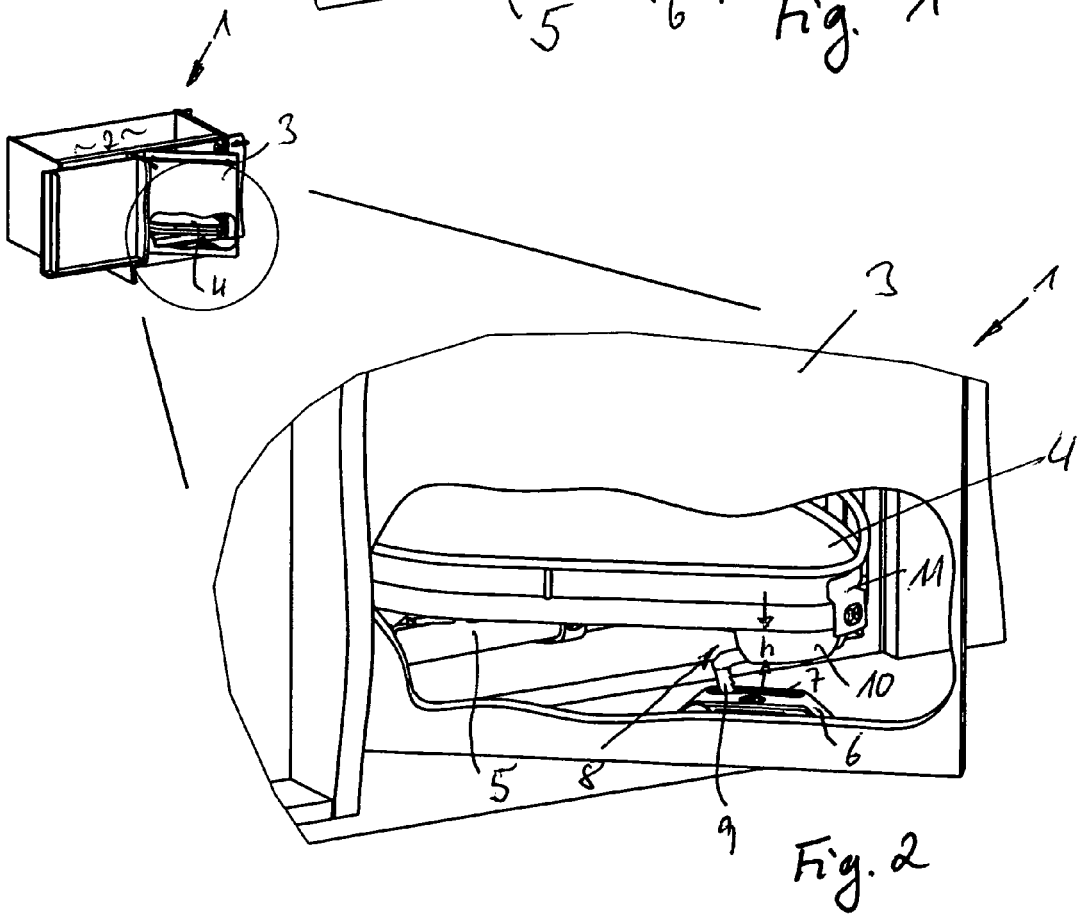
FIG. 2 an illustration in analogy to FIG. 1, with the door pivoted open by an opening angle of approximately 45°.

In the illustration according to FIG. 2, the door 3 is opened by an opening angle of approximately 45° wherein the shelf has been entrained by the driver 6 of the door opening 3 by means of the guide slot 7 and the coupling member 8 with the driver segment 9. Accordingly, the driver segment 9 has moved within the guide slot 7 and is now located in the end area of the guide slot 7.

Figure 3:
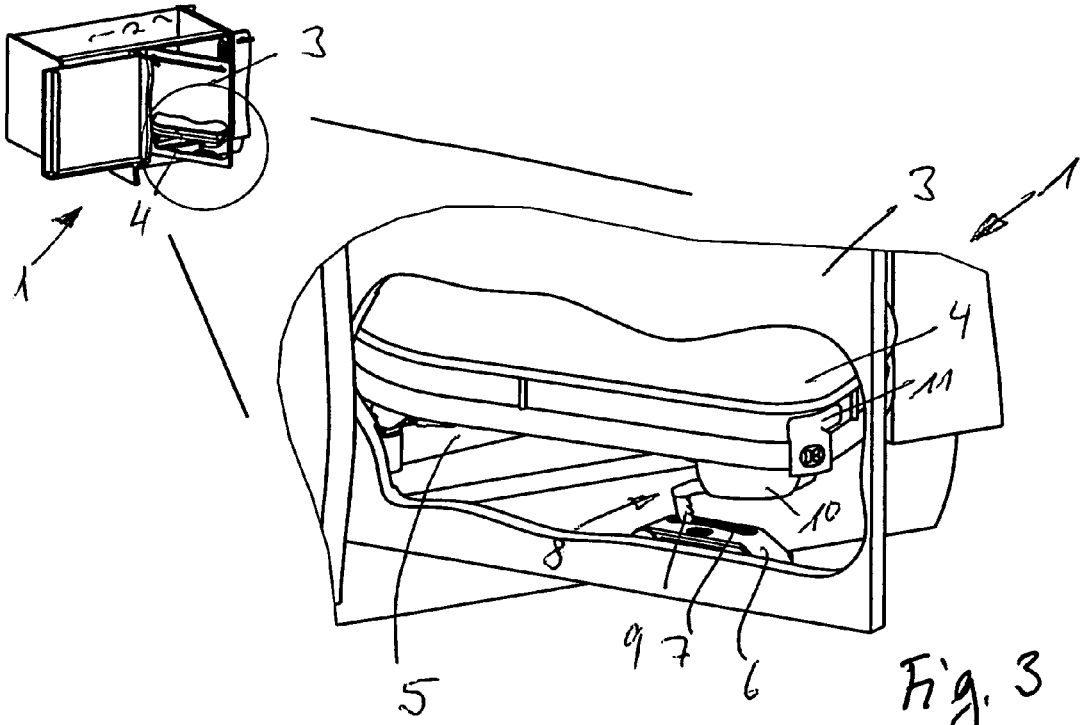
FIG. 3 an illustration in analogy to FIGS. 1 and 2, the door at an opening angle of approximately 60°.

In the illustration according to FIG. 3, the door has been opened by approximately 60° wherein the shelf 4 has again been entrained. The driver segment 9 of the coupling member 8 is still located in the left end area of the guide slot 7 because the second guide member 5 has caused a controlled movement so that the opening pivot action from 45° to 60°, with further entrainment of the shelf by the door, has taken place without a further movement of the driver segment 9 in the guide slot 7.

Figure 4:
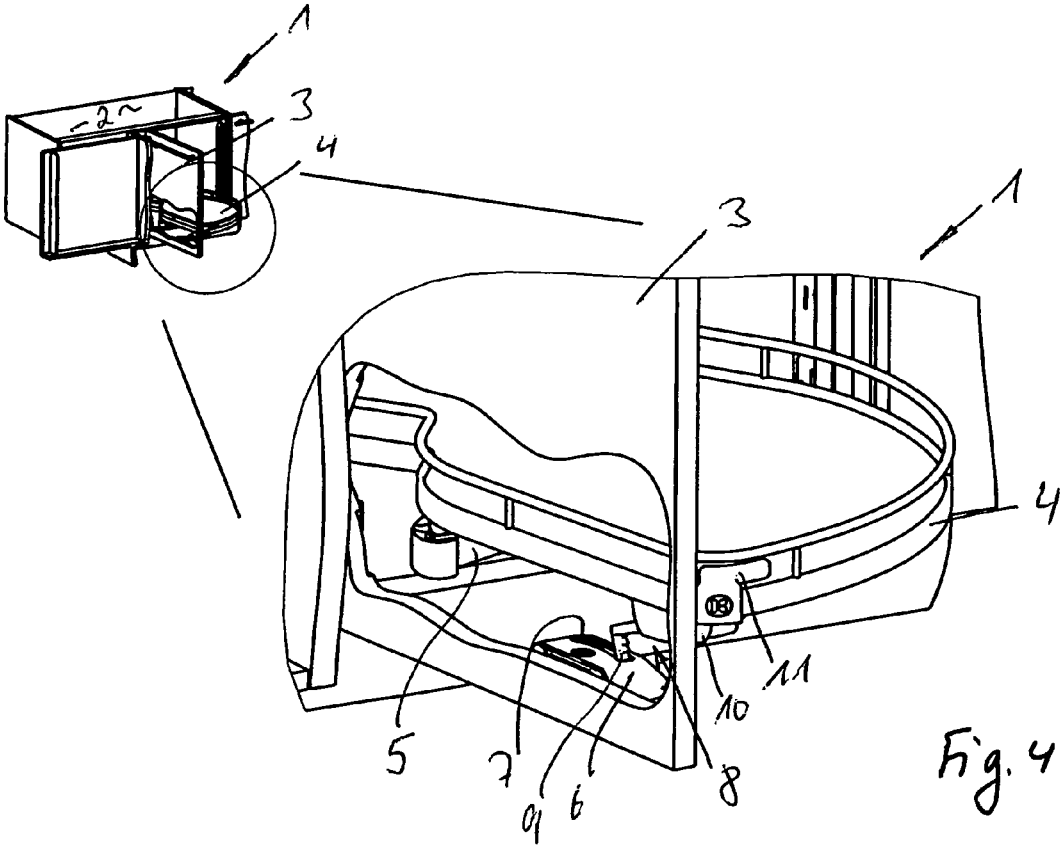
FIG. 4 an illustration in analogy to FIGS. 1 to 3, the door at an opening angle of approximately 85°.

In the illustration according to FIG. 4, the door 3 is pivoted open for the most part wherein the shelf 4 has again been entrained. The door has been pivoted open to approximately 85° wherein the driver segment 9 of the coupling member is again in the area to the right of the guide slot 7, caused by the controlled movement of the two guide members 5 that, as a whole, form a four-bar linkage with their connecting locations on the corner cabinet and the articulated locations at the bottom side of the shelf.

Figure 5:
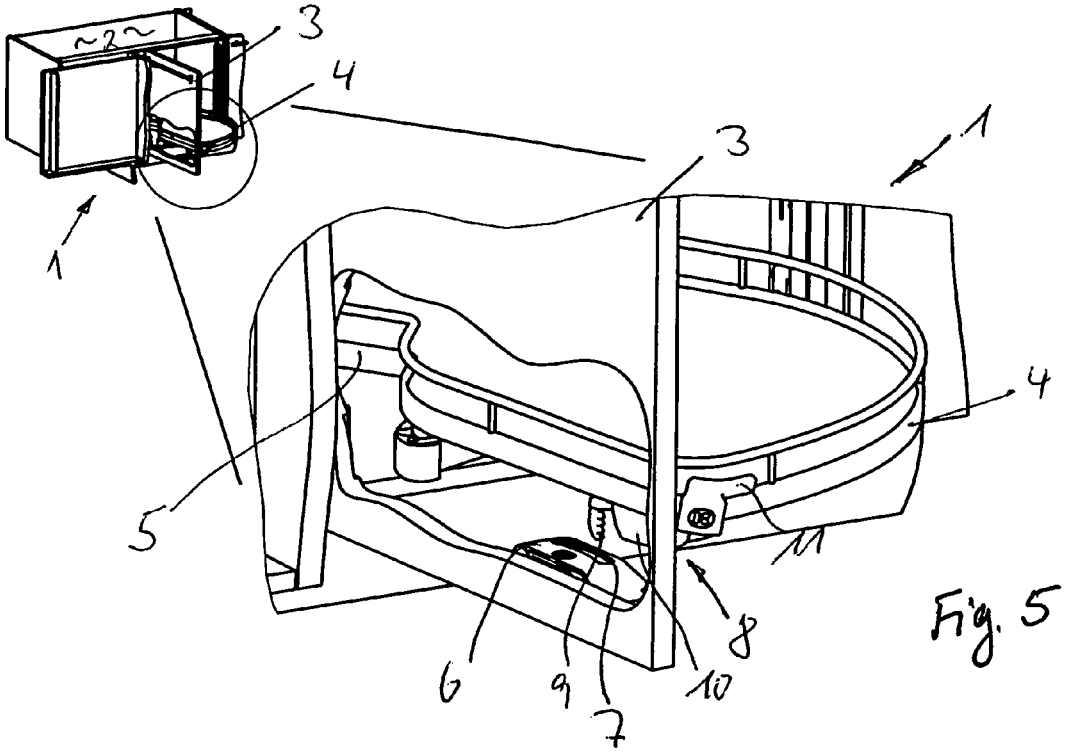
FIG. 5 an illustration in analogy to FIGS. 1 to 4, the door at an opening angle of approximately 85° with shelf decoupled.
Figure 6:
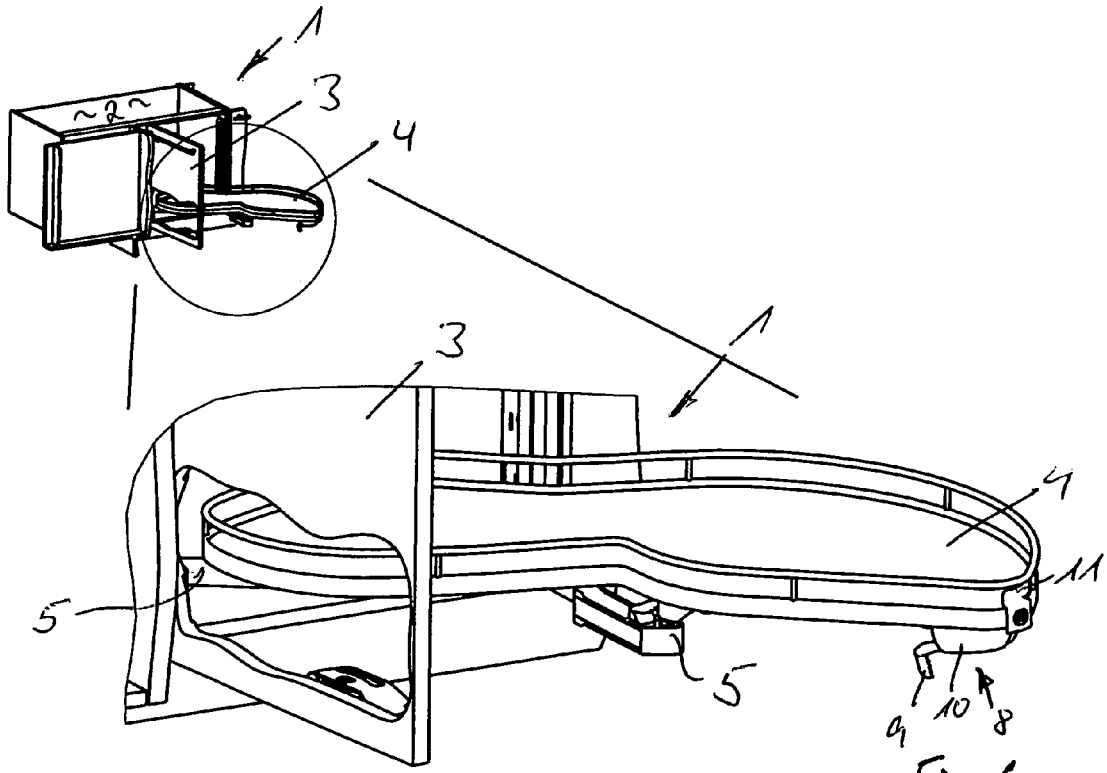
FIG. 6 an illustration in analogy to FIGS. 1 to 5, the door at an opening angle of approximately 85° with a shelf pivoted in front of the door opening.

In FIG. 5, the door 3 is in the same pivoted-open position as in FIG. 4, is therefore open completely. In FIG. 4 and in FIG. 5 the shelf has already been pivoted relatively far out of the cabinet interior 2 for fast access. The door 3 has also only been moved up to this point. Now, as indicated in FIG. 4, the coupling member 8 can be unlocked for a further opening pivot action of the shelf 4. For this purpose, the actuator 11 is actuated. In this way, the driver segment 9 of the coupling member 8 can be moved upwardly in that it can be pivoted about a substantially horizontally oriented axis. Subsequently, the shelf 4 is released from the driver 6 and can be transferred into the pivot position which is shown in FIG. 6 in which the shelf 4 is located for the most part in front of the cabinet 1 or the door opening.

Figure 7:
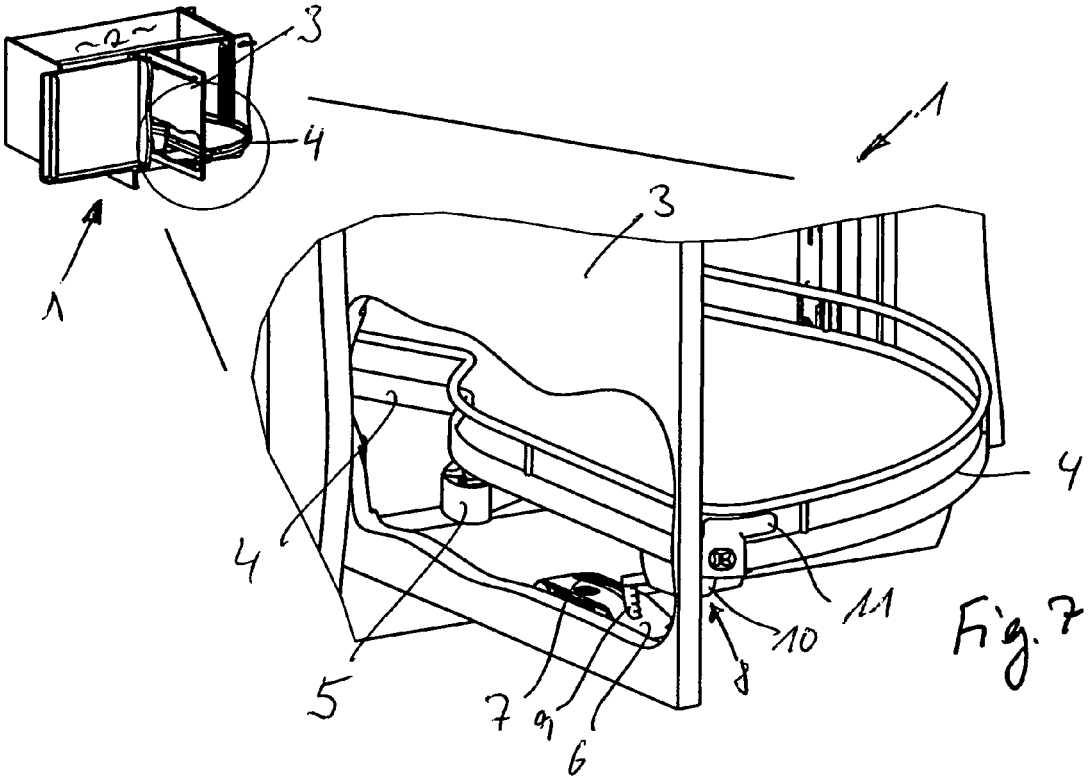
FIG. 7 an illustration in analogy to FIGS. 1 to 6 with shelf pivoted back during a coupling action.
Figure 8:
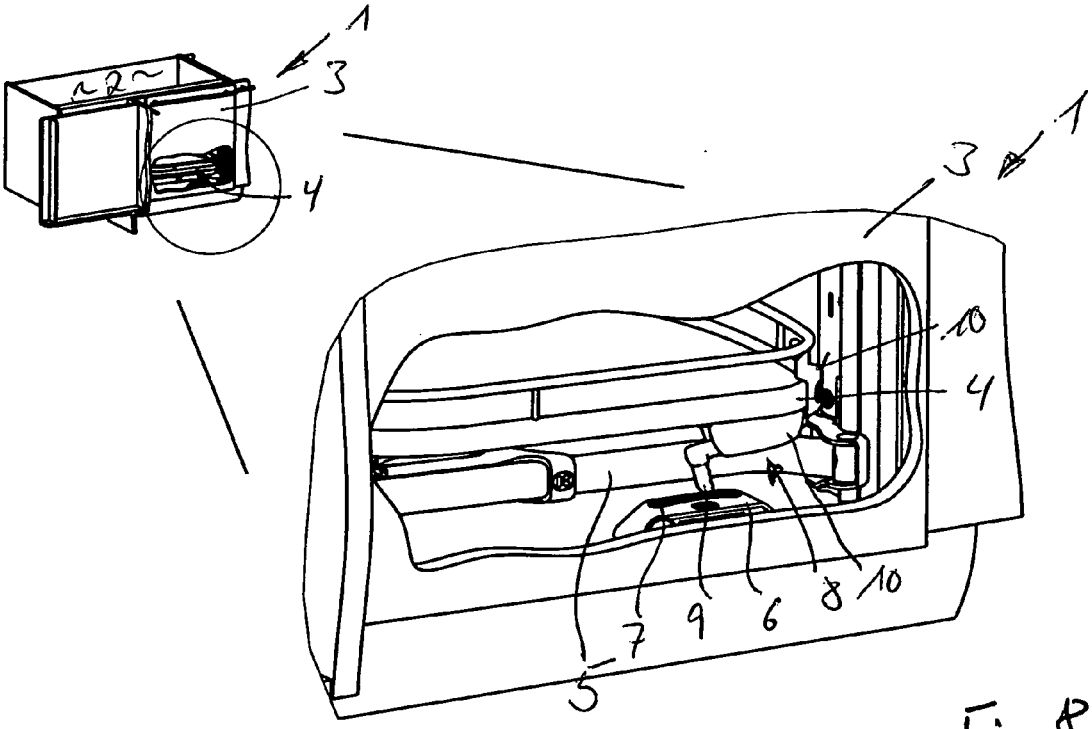
FIG. 8 an illustration in analogy to FIGS. 1 to 7 with the shelf pivoted back and the door pivoted back in the coupled state.

FIG. 7 now shows the process when the shelf 4 is pivoted back. Now the coupling member 8, and thus also the driver segment 9, reaches the driver 6 attached to the door 3. The driver has slanted surfaces as can be seen in more detail in FIG. 10. The driver segment 9 glides along these slanted surfaces in upward direction, causing the actuator 11 to pivot back, and meets the guide slot 7 and can dip into it. Subsequently, the shelf 4 and the door 3 are coupled again and can be moved together into the closed position, as is illustrated in FIG. 8.

In FIG. 9, the individual parts of the coupling member 8 at the bottom side of the shelf 4 are illustrated. Of course, also other configurations of the coupling member are conceivable. In this embodiment, a holder 10 is provided that can be clipped onto a counter member 12 at the shelf 4. In the rearward area, the holder 10 has a pivot bolt 13 onto which can be clipped an eye-shaped part 14 of a coupling bar 15 whereby a pivotability of the tilting coupling bar 15 and thus the height adjustability and thus the pivotability of the driver segment 9 results. The same holds true also for the actuator 11. By means of the actuator 11, the pivot action of the bar 15 and the pivot action of the driver segment 9 can be also triggered. In turn, as the bar 15 impacts on the slanted surfaces of the driver 6, the coupling bar 15 and thus the driver segment 9 can pivot about the axis of the pivot bolt 13 so that the driver segment 9 can move in upward direction.

In FIG. 10, the driver 6 with its guide slot 7 is illustrated again in detail. It can be attached to the door by means of a counter member which carries the reference character 16. Between the counter member 16 and the main part of the driver 6 there is a slide 17 which is interacting with adjusting screws 18 and 19 so that by means of the slide 17 the driver 6 is lengthwise adjustable and height-adjustable for positional adjustment.

The invention claimed is:

1. A fitting for a corner cabinet comprising an interior that is accessible via a corner cabinet door closing a cabinet opening at a front side of the corner cabinet and is substantially rectangular in horizontal section, the fitting comprising:

at least one support adapted to be stationarily supported in the interior of the corner cabinet;

at least one one-part shelf having a substantially semicircular basic shape;

wherein the at least one support comprises at least one guide member supporting the at least one shelf;

wherein the at least one guide member is configured to transfer the at least one shelf on a predetermined movement path from an inner position in the interior of the corner cabinet into an outer position that is substantially located in front of a door opening of the corner cabinet;

wherein the at least one guide member is articulated on a bottom side of the at least one shelf and is adapted to be connected pivotably by a support fitting with a part of the corner cabinet;

a driver device adapted to couple the corner cabinet door and the at least one shelf during at least one segment of an opening movement of the corner cabinet door;

wherein the driver device comprises a driver that is adapted to be stationarily attached to the corner cabinet door and comprises a guide slot;

wherein the driver device further comprises a releasable coupling member secured to the at least one shelf;

wherein the coupling member has a height-adjustable driver segment that is insertable and moveable within the guide slot when inserted in the guide slot;

wherein the coupling member effects a driver action between the corner cabinet door and the at least one shelf when the driver segment in a driver position engages the guide slot;

wherein the driver segment is adapted to be released into an unlocked position from the guide slot by a manually activated height adjustment of the driver segment;

wherein, from the unlocked position, the driver segment is automatically inserted into the guide slot and into the driver position by a relative movement of the at least one shelf relative to the corner cabinet door;

wherein the driver is adapted to be secured on the corner cabinet door so as to be lengthwise slidable and/or height-adjustable;

wherein the driver has two driver parts that are adjustable relative to each other by an adjusting slide.

2. The fitting according to claim 1, further comprising a securing device provided on a bottom side of the at least one shelf, wherein the coupling member is clipped onto the securing device.

3. The fitting according to claim 1, wherein the coupling member has a pivotable coupling bar on which the driver segment is provided.

4. The fitting according to claim 3, wherein the coupling bar is angled and the driver segment in a first pivot position of the coupling bar dips into the guide slot and in a second pivot position of the coupling bar is removed from the guide slot.

5. The fitting according to claim 1, wherein the driver has slanted surfaces and wherein the coupling member glides across the slanted surfaces and causes the driver segment to be automatically inserted into the guide slot.

6. The fitting according to claim 1, wherein, for releasing the driver segment from the guide slot, the coupling member comprises an activator that is adapted to be manually activated.

7. The fitting according to claim 6, wherein the actuator projects past a lateral edge of the at least one shelf.

8. The fitting according to claim 1, wherein the slide is adjustable by adjusting elements.

9. The fitting according to claim 1, wherein each one of the at least one shelf has associated therewith two of said at least one guide member that are each adapted to be connected pivotably to a wall of the corner cabinet in the area of the door opening with vertically spaced apart pivot axes.

* * * * *